United States Patent [19]

Taguma

[11] Patent Number: 5,000,135

[45] Date of Patent: Mar. 19, 1991

[54] GASOLINE ENGINE WITH SINGLE OVERHEAD CAMSHAFT HAVING DUEL EXHAUST CAMS PER CYLINDER WHEREIN EACH EXHAUST CAM HAS DUEL LOBES

[76] Inventor: Kunito Taguma, 2361 E. Manoa Rd., Honolulu, Hi. 96822

[21] Appl. No.: 564,106

[22] Filed: Aug. 8, 1990

[51] Int. Cl.[5] ..... F01L 1/28

[52] U.S. Cl. ..... 123/79 C; 123/151

[58] Field of Search ..... 123/79 C, 151, 90.1, 123/90.16, 90.27, 79 R

[56] References Cited

U.S. PATENT DOCUMENTS

| | | | |
|---|---|---|---|
| 2,211,013 | 8/1940 | Hosterman | 123/79 C |
| 2,213,202 | 9/1940 | Buchi | 123/79 C |
| 3,060,916 | 10/1962 | Buchi | 123/79 C |
| 4,503,817 | 3/1985 | Klomp et al. | 123/151 |
| 4,942,850 | 7/1990 | Hernandez | 123/79 C |
| 4,957,073 | 9/1990 | Bergeron | 123/79 C |

*Primary Examiner*—David A. Okonsky
*Attorney, Agent, or Firm*—Michael I. Kroll

[57] ABSTRACT

An improved gasoline engine using a spark plug and a spark plug wire is disclosed. The improved gasoline engine includes a cylinder having a cylinder wall and an upper end, a piston movably disposed within the cylinder, a gasoline injector for supplying the gasoline charge into the cylinder, a single tube exhaust valve movably mounted to the cylinder, a single overhead camshaft having duel exhaust cams for the cylinder with each exhaust cam having duel exhaust lobes, and a plurality of port holes contained in the cylinder around the cylinder wall in a ring-like fashion.

7 Claims, 1 Drawing Sheet

GASOLINE ENGINE WITH SINGLE OVERHEAD CAMSHAFT HAVING DUEL EXHAUST CAMS PER CYLINDER WHEREIN EACH EXHAUST CAM HAS DUEL LOBES

BACKGROUND OF THE INVENTION

1. Field of the Invention:

The present invention relates to a gasoline engine.

More particularly, the present invention relates to a gasoline engine with a single overhead camshaft having duel exhaust cams per cylinder wherein each exhaust cam has duel lobes.

2. Description of the Prior Art:

The gasoline engine is an internal combustion engine. The thermal energy which is released when the gasoline is burned is converted into mechanical energy. In the gasoline engine, the liquid gasoline is mixed with air to form a combustible mixture, which is compressed in the cylinder and finally ignited by an electric spark produced between the electrodes of a sparking plug. The gases which are formed in the cylinder by the combustion of the gasoline and air mixture expand and thrust the piston downwards. Acting through the connecting rod, the piston imparts a rotary motion to the crankshaft. The spent burned gases must then be removed from the cylinder and be replaced by fresh gasoline and air mixture, so that a fresh cycle can begin. The energy needed for effecting this change in the contents of the cylinder is provided by the flywheel, which stores up some of the mechanical energy released by the combustion that takes place in the cylinder. The additional energy developed by the engine can be taken off at the end of the crankshaft.

With internal combustion engines, a distinction is made between four stroke and two stroke operation. To perform a full cycle of operations, the four stroke engine requires four, and the two stroke engine requires two strokes of the piston.

Four Stroke engine

1st stroke: induction stroke: while the inlet valve is open, the descending piston draws fresh gasoline and air mixture into the cylinder.

2nd stroke: compression stroke: While the valves are closed, the rising piston compresses the mixture to a pressure of about 7–8 atm, the mixture is then ignited by the sparking plug.

3rd stroke: power stroke: While the valves are closed, the pressure of the gases of combustion forces the piston downwards.

4th stroke: exhaust stroke: the exhaust valve is open and the rising piston discharges the spent gases from the cylinder.

Since power is developed during one stroke only, the single cylinder four stroke engine has a low degree of uniformity, i.e., the rotation of the crankshaft is subject to considerable accelerations and decelerations during a cycle. More uniform, that is to say, smoother, running is obtained with multi-cylinder engines because the "cranks" of the crankshaft are staggered in relation to one another so that the various cylinders do not develop their power strokes simultaneously, but successively, and sometimes in an overlapping sequence. Depending on the cylinder arrangement, various types of engine, for various types of usage, are available.

In this type of engine, the piston periodically covers and uncovers opening known as ports in the cylinder wall. The two stroke engine is seldom equipped with valves.

At the start of the first stroke, the piston is in its highest position. When the compressed gasoline and air over the piston is ignited, the latter is thrust downwards and, in so doing, releases the exhaust port. The burned gases in the cylinder, which are still under high pressure, can thus escape through this port. When the piston descends further, its upper edge releases the inlet port, which admits fresh gasoline mixture into the cylinder, so that the remaining burned gases are flushed out. When the piston rises again, second stroke, all the ports are closed for a time, and during this period the gasoline and air mixture is compressed, so that a fresh cycle can commence.

The crankcase scavenged two stroke engine has no scavenging fan. Instead, the crankcase is hermetically sealed, so that it can function as a pump in conjunction with the piston. When the piston ascends, a partial vacuum is produced in the crankcase, until the lower edge of the piston releases the inlet port and thus opens the way to the fresh gasoline and air mixture into the crankcase. When the piston descends, the mixture in the crankcase is compressed a little so that, as soon as the top of the piston releases the transfer port and overflow duct connecting the crankcase to the cylinder, it can enter the cylinder. Meanwhile, what happens above the piston is, as above.

In the latter type of two stroke engine the fan adds to the cost. However, as the overflow duct between the cylinder and crankcase is eliminated, the crankshaft is provided with forced oil lubrication without involving a risk that the oil in the crankcase can find its way into the cylinder. In the cheaper crankcase-scavenged engine, the lubricating oil is mixed with the gasoline, or is, alternatively, supplied to the points of lubrication dropwise by small lubricating oil pumps. The oil which enters the crankcase is liable to be carried through the overflow duct and transfer port into the cylinder, whence it passes through the exhaust port and into the exhaust system, where it may manifest itself as blue smoke in the exhaust.

Numerous innovations for gasoline engines have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a gasoline engine that avoids the disadvantages of the prior art.

More particularly, it is an object of the present invention to provide a gasoline engine which can operate with a compression ratio of at least 10:1 without experiencing pre-ignition even with unleaded or low octane gasoline, and since power is up, RPMs can be down so that less fuel is used and less pollution is produced.

In keeping with these objects, and with others which will become apparent hereinafter, one feature of the present invention resides, briefly stated, in an improved gasoline engine using a spark plug and a spark plug wire, comprising, a cylinder having a cylinder wall and an upper end, a piston movably disposed within the cylinder, a gasoline injector for supplying the gasoline charge into the cylinder, a single tube exhaust valve movably mounted to the cylinder, a single overhead camshaft having duel exhaust cams for the cylinder with each exhaust cam having duel exhaust lobes, and a plurality of port holes contained in the cylinder around the cylinder wall in a ring-like fashion.

In accordance with another feature of the present invention, the overhead cam moves on the upper end of the cylinder.

Another feature of the present invention is that the single tube exhaust valve includes a hollow tubular body having an upper end with a lip and a lower end with a flair.

Yet another feature of the present invention is that the spark plug and the spark plug wire are disposed in the hollow tubular body.

Still another feature of the present invention is that the gasoline injector is disposed in engine head.

Yet still another feature of the present invention is that it further comprises a spring for biasing the lip from the engine head.

Still yet another feature of the present invention is that the top of the piston contains a hemispherically shaped combustion chamber.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figures 1, 2, 3, 4, 5:
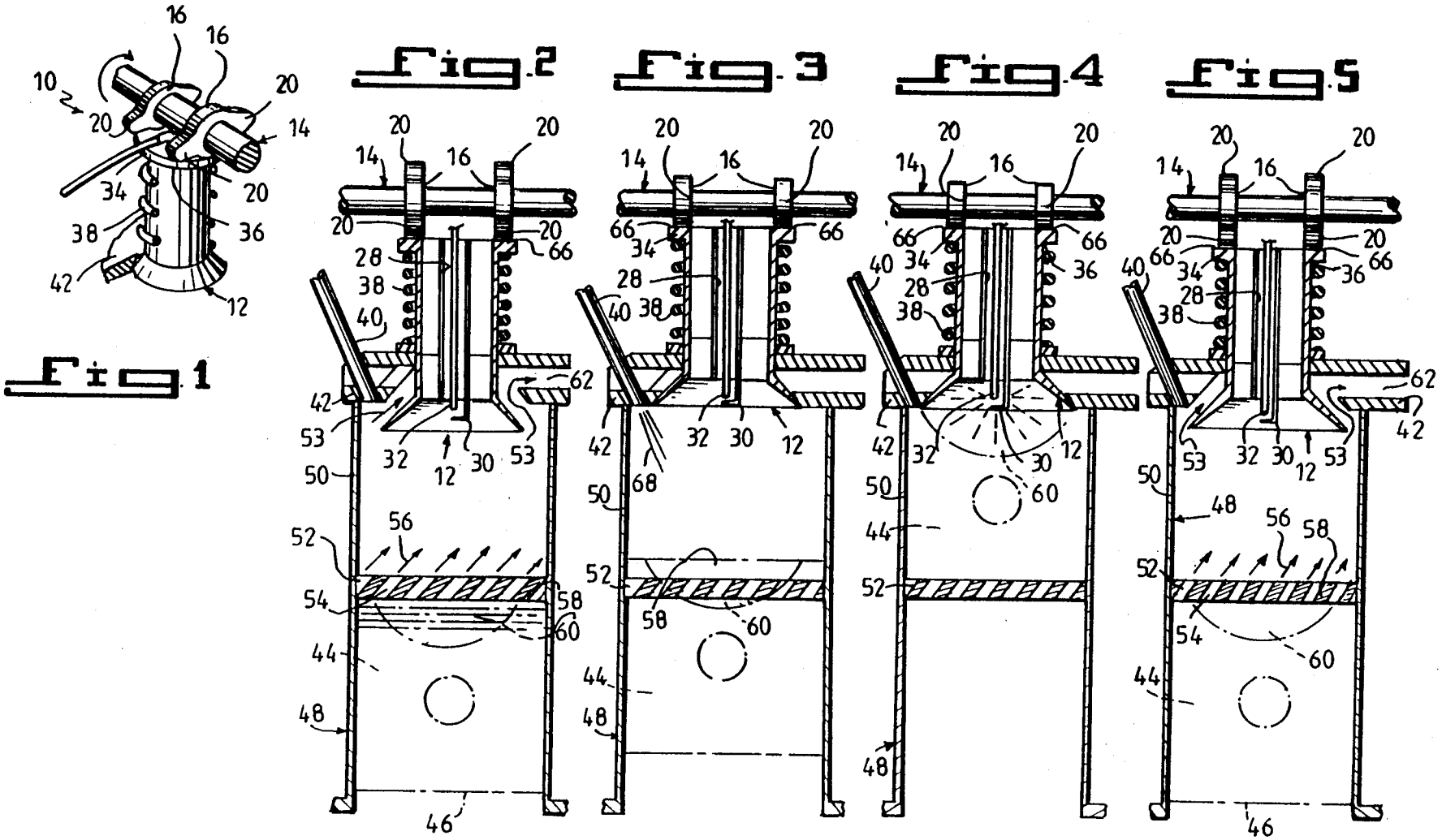
FIG. 1 is a perspective view of the single tube exhaust valve of the present invention.
FIG. 2 is a cross sectional view of the present invention during the induction stroke.
FIG. 3 is a cross sectional view of the present invention during the compression stroke.
FIG. 4 is a cross sectional view of the present invention during the ignition stroke.
FIG. 5 is a cross sectional view of the present invention during the exhaust stroke.

10—gasoline engine with a single overhead camshaft having duel exhaust cams per cylinder wherein each exhaust cam has duel lobes of the present invention
12—single tube exhaust valve
14—single overhead camshaft
16—cams
20—lobes
28—longitudinal throughbore
30—spark plug
32—spark plug ignition wire
34—circumferential lip
36—upper end
38—valve spring
40—gasoline injector
42—engine head
44—piston
46—bottom dead center (BDC)
47—top dead center (TDC)
48—cylinder
50—cylinder wall
52—plurality of port holes
53—burnt charge
54—super turbo
56—induction air
58—top
60—hemispherical combustion chamber
62—exhaust
66—two diametrically opposed points
68—gas charge

DETAILED DESCRIPTION OF THE PREFERRED EMBODIMENT

Referring now to the FIGURES, the gasoline engine 10 of the present invention includes a single tube exhaust valve 12, and a single overhead camshaft 14 having cams 16 with lobes 20.

The single tube exhaust valve 12 contains a longitudinal throughbore 28 which houses a spark plug 30 and the spark plug ignition wire 32. A circumferential lip 34 is disposed at the upper end 36 of the single tube exhaust valve 12.

The lip 34 functions as a spring retainer 36. The valve spring 38 circumvents the single tube exhaust valve 12 and biases the lip 34 upwardly.

During the induction stroke, shown in FIG. 2, the single tube exhaust 12 is open and the gasoline injector 40 is shown disposed in the engine head 42. The gasoline injector 40 and the spark plug 30 remain idle during the induction stroke.

The single tube exhaust valve 12 is opened by the lobes 20 of the cams 16 of the camshaft 14, as the camshaft 14 rotates. In the open position, the lobes 20 press down on the single tube exhaust valve 12, causing the single tube exhaust valve 12 to move downwardly against the biasing action of the spring 38 and causing the spring 38 to compress.

During the induction stroke, the piston 44 is disposed at the bottom dead center (BDC) 46 of the cylinder 48, below the plurality of port holes 52 that are contained around the cylinder wall 50 of the cylinder 48, in a single ring-like fashion. Since the piston 44 and are therefore open.

A super turbo 54 provides induction air 56 to rush through the plurality of open port holes 52, and push the burnt charge 53 out of the exhaust 62, during the induction stroke. Furthermore, the top 58 of the piston 44 contains a hemispherical combustion chamber 60 which can yield a high compression ratio, for example 10:1.

Since the longitudinal throughbore 28 is present at the center of a single tube exhaust valve 12, both the spark plug 30 and the spark plug wire 32 can pass therethrough.

The single overhead camshaft 14 provides double cams 16 at each cylinder 48, and whose lobes 20 ride on two diametrically opposed points 66 on the valve retainer lip 34 of the single tube exhaust valve 12. The lobes 20 flank the spark plug 30 and the spark plug wire 32. Additionally, because the spark plug 30 is disposed in the center of the cup of the single tube exhaust valve 12, there is no pre-ignition even when using low octane gasoline.

During the compression stroke, shown in FIG. 3, the single tube exhaust valve 12 is closed and the gasoline injector 40 is shown disposed in the engine head 42. The gasoline injector 40 injects a gas charge 68 into the closed single tube exhaust valve 12. The single tube exhaust valve 12 is closed by the biasing action of the expanded spring 38.

During the compression stroke, the piston 44 is disposed intermediate the cylinder 48 and blocking the plurality of port holes 52, that are contained around the cylinder wall 50 of the cylinder 48, in a single ring-like fashion. Since the piston 44 blocks the plurality of port holes 52, the plurality of port holes 52 are therefore closed.

The super turbo 54 and the spark plug 30 remain idle during the compression stroke.

During the ignition stroke, shown in FIG. 4, the single tube exhaust valve 12 is closed and the gasoline injector 40, is shown disposed in the engine head 42. The gasoline injector 40 remains idle while the spark plug 30 fires. The single tube exhaust valve 12 is closed by the biasing action of the expanded spring 38.

During the ignition stroke, the piston 44 is disposed top dead center (TDC) 47 of the cylinder 48 and blocking the plurality of port holes 52, that are contained around the cylinder wall 50 of the cylinder 48, in a single ring-like fashion.

Since the piston 44 blocks the plurality of port holes 52, the plurality of port holes 52 are therefore closed.

The super turbo 54 remains idle while the spark plug 30 fires, during the ignition stroke.

During the exhaust stroke, shown in FIG. 5, the single tube exhaust valve 12 is open and the gasoline injector 40, is shown disposed in the engine head 42. The gasoline injector 40 and the spark plug 30 remain idle during the exhaust stroke.

The single tube exhaust valve 12 is opened by the lobes 20 of the cams 16 of the camshaft 14, as the camshaft 14 rotates. In the open position, the lobes 20 press down on the single tube exhaust valve 12, causing the single tube exhaust valve 12 to move downwardly against the biasing action of the spring 38 and causing the spring 38 to compress.

During the exhaust stroke, the piston 44 is disposed at the bottom dead center (BDC) 46 of the cylinder 48, below the plurality of port holes 52 that are contained around the cylinder wall 50 of the cylinder 48, in a single ring-like fashion. Since the piston 44 is below the plurality of port holes 52, the port holes 52 are not blocked by the piston 44 and are therefore open.

The super turbo 54 provides induction air 56 to rush through the plurality of open port holes 52, and push the burnt charge 53 out of the exhaust 62, during the exhaust stroke.

It will be understood that each of the elements described above, or two or more together, may also find a useful application in other types of constructions differing from the type described above.

While the invention has been illustrated and described as embodied in a gasoline engine with a single overhead camshaft having duel exhaust cams per cylinder wherein each exhaust cam has duel lobes, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An improved gasoline engine using a spark plug and a spark plug wire, comprising:

(a) a cylinder having a cylinder wall and an upper end;

(b) a piston movably disposed within said cylinder;

(c) a gasoline injector for supplying the gasoline charge into said cylinder;

(d) a single tube exhaust valve movably mounted to said cylinder;

(e) a single overhead camshaft having duel exhaust cams for said cylinder with each exhaust cam having duel exhaust lobes; and (f) a plurality of port holes contained in said cylinder around said cylinder wall in a ring-like fashion.

2. An engine as defined in claim 1, wherein said overhead cam moves on said upper end of said cylinder.

3. An engine as defined in claim 2, wherein said single tube exhaust valve includes a hollow tubular body having an upper end with a lip and a lower end with a flair.

4. An engine as defined in claim 3, wherein the spark plug and the spark plug wire are disposed in said hollow tubular body.

5. An engine as defined in claim 4, wherein said gasoline injector is disposed in engine head.

6. An engine as defined in claim 5; further comprising a spring for biasing said lip from said engine head.

7. An engine as defined in claim 6, wherein said top of said piston contains a hemispherically shaped combustion chamber.

* * * * *